US005855299A

United States Patent [19]

Arnold et al.

[11] Patent Number: 5,855,299

[45] Date of Patent: Jan. 5, 1999

[54] PLASTIC CONTAINER DISPENSING FITMENT

[75] Inventors: Jay C. Arnold, Landisville; David W. Cargile, Lititz, both of Pa.

[73] Assignee: Graham Packaging Corporation, York, Pa.

[21] Appl. No.: 833,317

[22] Filed: Apr. 4, 1997

[51] Int. Cl.[6] ..... B07D 1/16

[52] U.S. Cl. ..... 222/109; 222/571

[58] Field of Search ..... 222/109, 111, 222/571, 569

[56] References Cited

U.S. PATENT DOCUMENTS

| | | |
|---|---|---|
| 3,318,496 | 5/1967 | Ayotte et al. . |
| 4,550,862 | 11/1985 | Barker et al. . |
| 4,706,829 | 11/1987 | Li . |
| 4,773,560 | 9/1988 | Kittscher . |
| 4,830,234 | 5/1989 | Odet . |
| 4,890,770 | 1/1990 | Haga et al. . |
| 4,917,268 | 4/1990 | Campbell et al. . |
| 4,984,714 | 1/1991 | Sledge . |
| 5,020,699 | 6/1991 | Sams . |
| 5,058,772 | 10/1991 | Moore et al. . |
| 5,108,009 | 4/1992 | Davidson et al. . |
| 5,188,249 | 2/1993 | Cargile . |
| 5,234,130 | 8/1993 | Benioff et al. . |
| 5,251,788 | 10/1993 | Moore . |
| 5,322,662 | 6/1994 | Benioff et al. . |
| 5,435,467 | 7/1995 | Ekkert et al. . |
| 5,566,862 | 10/1996 | Haffner . |

*Primary Examiner*—Philippe Derakshan
*Attorney, Agent, or Firm*—Howson and Howson

[57] ABSTRACT

A fitment for use on a container for dispensing liquids. The fitment provides a pouring spout and a drain back function and is secured within the container finish. The container finish has a neck with a rim and a shoulder. The fitment has an outer wall with upper and lower ends and with a frusto-conical shape to ensure that a portion of the outer wall frictionally engages the container finish when the fitment is inserted into the container finish to prevent the fitment from being inserted completely through the neck of the container. An annular bead extends outwardly from the outer wall a spaced distance from the upper end of the outer wall so that when the fitment is engaged in the neck of the container, the bead is positioned directly under the shoulder of the neck. Multiple bands of sealing engagement are created between the fitment and the container fitment to ensure a leak-free connection.

14 Claims, 3 Drawing Sheets

PLASTIC CONTAINER DISPENSING FITMENT

FIELD OF THE INVENTION

The present invention relates to a container which is useful for dispensing a consumer liquid product in a precise, ready and spill-free manner, and more particularly, the present invention relates to a separately formed plastic container body, fitment and cap which, when assembled, provide a container having a pouring spout, a cap useful as a liquid measuring device, and drain back of liquid remaining on the spout and cap after pouring.

BACKGROUND OF THE INVENTION

Separately formed fitments placed within the opening of blow-molded plastic containers is commonplace in packaging certain liquid consumer products such as laundry detergents. The fitment is retained in the finish of the container and provides the container with a spout to improve pouring control. A cap is engageable with the finish of the container to close the container and is useful as a measuring device so that a precise amount of liquid can be poured, for instance, the suggested amount of liquid detergent for a medium sized load of laundry. The fitment also provides a drain back function so that when the container is closed after pouring, any residual liquid on the cap and spout, neatly returns to the inside of the container body. Thus, a consumer can repeatedly dispense a precise amount of liquid from the container without spillage or leakage.

Examples of container assemblies for dispensing consumer liquid products are provided in U.S. Pat. Nos. 5,566,862 issued to Haffner, 5,435,467 issued to Ekkert et al., 5,251,788 issued to Moore, 5,108,009 issued to Davidson et al., 5,058,772 issued to Moore et al., 5,020,699 issued to Sams, 4,917,268 issued to Campbell et al., 4,890,770 issued to Haga et al., 4,706,829 issued to Li, and 4,550,862 issued to Barker. Each assembly includes a plastic container body, a fitment having a spout, and a cap. As disclosed in these patents, and as experienced in practice, several problems can arise with such a product.

The fitment must be firmly secured within the opening of the container body during assembly, filling, transportation, handling and use. However, the fitment should be capable of ready and consistent insertion by high speed automated equipment into their proper position within the opening of the container. Problems occur when a proper balance is not achieved between providing a secure fit and one that is easily accomplished. For example, a fitment designed to snap-fit to the neck of a container, such as disclosed in the Ekkert et al. '467 patent, requires precise molding of both the container finish and the fitment. If not, difficulties may be encountered when pressing the fitment into the neck to effect a snap-fit.

The fitment-to-container connection should be leak-free. Even though the fitment may be securely positioned within the opening of the container, leaks can occur between the fitment and the container. This generally has the unwanted result of liquid dripping down the exterior side of the container body. One cause of leaks results from the manufacturing tolerances experienced during formation of the inside diameter of the container finish relative to the outside diameter of the fitment. Another cause of leaks with respect to fitments designed to extend above the rim of the container finish is that these type of fitments rely on compression between the cap and the flange when the container is closed. Inadequate compression can cause leaks; excessive compression can unduly stress the plastic.

Although various ones of the referenced container assemblies having separately formed fitments with spouts may function satisfactorily for their intended purposes, there is a need for a fitment which is readily secured in position in the opening of a container and which prevents the occurrence of leaks between the fitment and container finish.

OBJECTS OF THE INVENTION

With the foregoing in mind, a primary object of the present invention is to provide a fitment which is readily secured within the finish of a blow-molded plastic container despite variations in manufacturing tolerances experienced during molding operations.

Another object of the present invention is to provide a fitment-to-container connection which provides multiple bands of sealing engagement therebetween to ensure creation of a leak-free fit.

A further object is to provide a container having a separately attached dispensing fitment which is inexpensive to manufacture and assembly into a container.

SUMMARY OF THE INVENTION

More specifically, the present invention provides a fitment for use on a container for dispensing liquids. The container has a finish with an opening defined by a neck, and the neck has a rim and a shoulder. The fitment has an outer wall engageable against the neck of the container within the opening of the container. The outer wall has upper and lower ends and is frustoconical in shape to ensure that a portion of the outer wall frictionally engages the neck of the container when the fitment is inserted into the opening of the container. The frustoconical shape also prevents the fitment from being capable of insertion completely through the neck of the container.

An annular bead extends outwardly from the outer wall a spaced distance from the upper end of the outer wall so that when the fitment is engaged in the neck of the container, the bead is positioned directly under the shoulder of the neck. This ensures that the fitment does not dislodge from the neck of the container during pouring.

The fitment also includes a spout and a drain portion. The spout is spaced from and is surrounded by the outer wall. It provides controlled pouring from the container. The drain portion of the fitment connects the spout to the lower end of the outer wall and provides a path of flow for liquid draining back into the container after pouring.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 1:
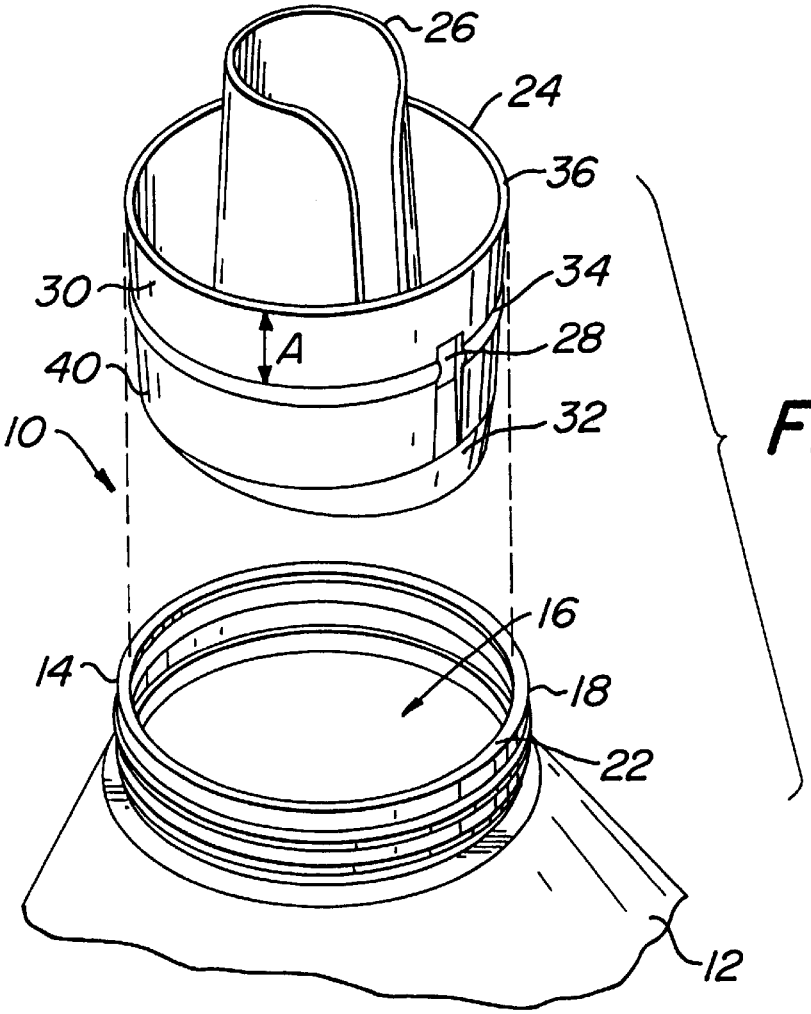
FIG. 1 is an exploded perspective view of a fitment and container finish embodying the present invention.
Figure 2:
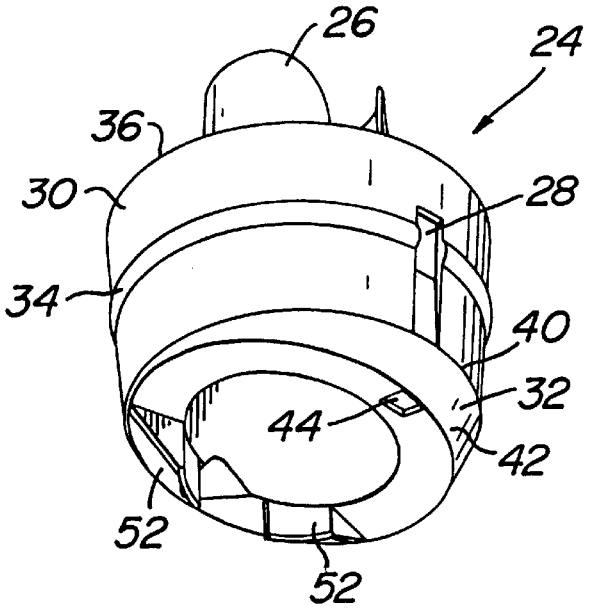
FIG. 2 is an perspective view of the bottom of the fitment illustrated in FIG. 1.
Figure 3:
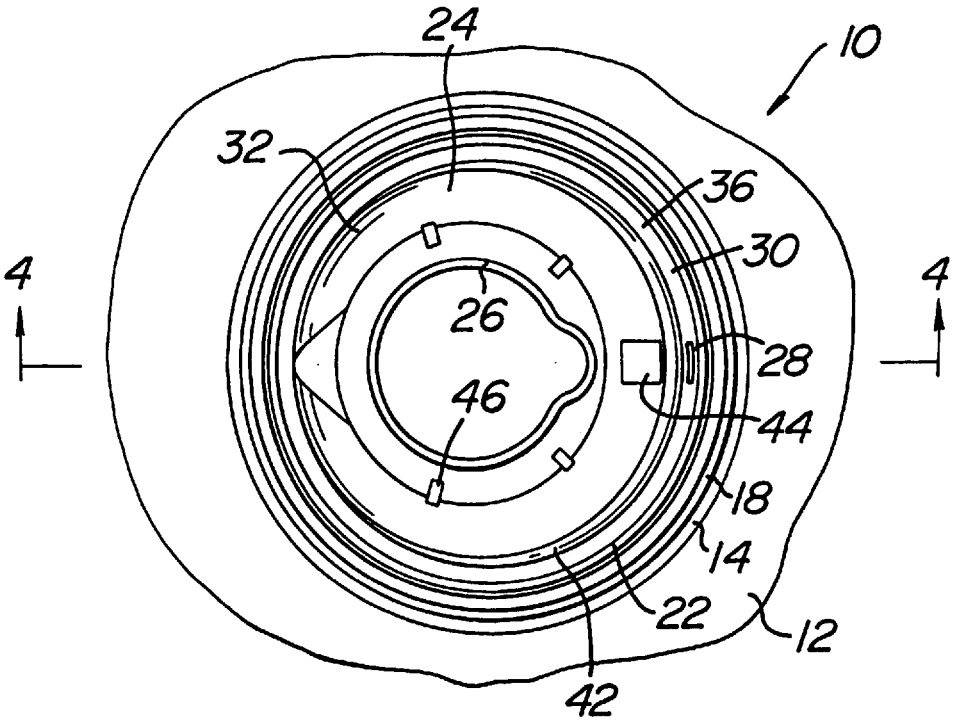
FIG. 3 is a top plan view of the fitment secured within the container finish.
Figure 4:
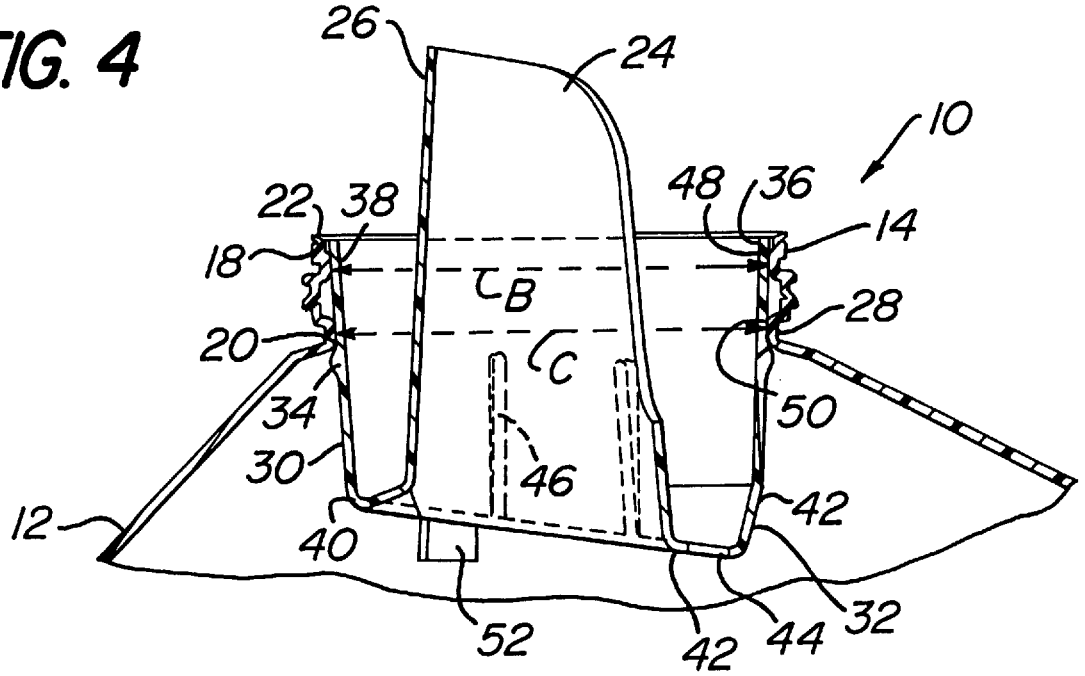
FIG. 4 is a cross-section elevational view of the fitment and container finish illustrated in FIG. 3 along line 4—4.
Figure 5:
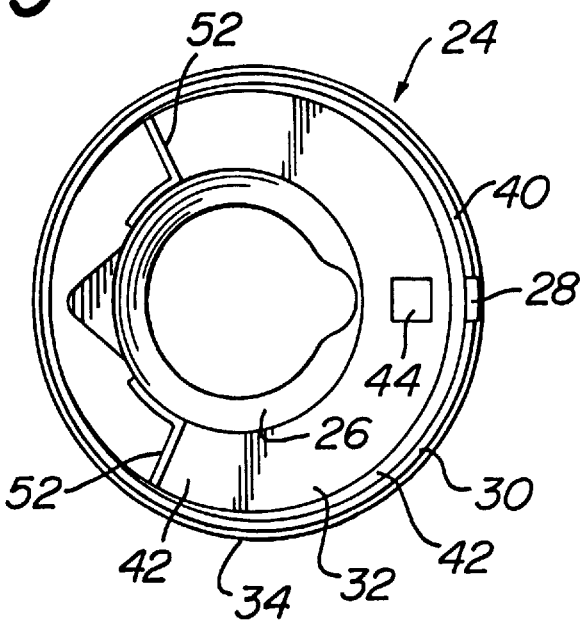
FIG. 5 is a bottom plan view of the fitment illustrated in FIG. 1.

The assembled container 10 according to the present invention provides a convenient package for liquid consumer products such as laundry detergent. The container reduces the potential for unwanted spillage and leakage of the liquid from the container and provides a consumer with a ready means of dispensing precise measured quantities of the liquid.

A container body 12 provides a vessel for storing the liquid and is configured so that it can be easily manipulated. To this end, although not shown, the body 12 can be formed with a handle so that the container can be manipulated with one hand. Preferably, the body 12 is made of plastic by conventional blow-molding processes. The body 12 is formed with a finish 14 providing an opening 16 for filling the container and dispensing the liquid. The opening 16 is defined by a neck 18 which extends from a shoulder 20 to a rim 22. The neck 18 has an exterior wall with threads 20 for cooperatively engaging a cap (not shown).

The cap provides the function of sealing the container body 12 and is useful in measuring quantities of liquid dispensed from the container. The cap is designed such that when it is replaced onto the container body 12, any residual liquid on the interior wall of the cap drains back into the container body 12 and not down the exterior sides of the container.

A fitment 24 is secured within the opening 16 of the container body 12 to provide a pouring spout 26 for dispensing liquid from the container body 12 and to provide a path of flow for residual liquid draining back into the container body 12. The fitment 24 also provides means for readily dispensing the last remaining quantity of liquid in a container which is nearly empty through a near-empty pouring aperture 28 as will be discussed.

One of the novel aspects of the present invention is the unique structure of the fitment 24. The fitment 24 is specifically designed so that it is readily engaged with the container body 12, will not dislodge during pouring, and provides a leak-free seal with the neck 18 of the container body 12. The fitment 24 includes the spout 26 as discussed above, an outer wall 30 for engaging the neck 18 of the container body 12 to secure the fitment 24 within the opening 16, and a sump, or drain portion, 32 for connecting the spout 26 to the outer wall 30 and for providing a path of flow for the residual liquid.

The fitment 24 is retained within the neck 18 by friction created between the outer wall 30 and the interior surface 38 of the neck 18. To this end, the outer wall 30 is inwardly tapered from its upper end 36 to a locking bead 34 formed thereon. Thus, the outer wall 30 above the locking bead 34 is frustoconical in shape. Preferably, as illustrated, the entire outer wall 30 is frustoconical, i.e., tapered from its upper end 36 to its lower end 40.

The outer wall 30 above the locking bead 34 has a constant thickness and is devoid of any irregularities such as flanges, beads or other structures. The smooth frustoconical shape of the outer wall 30 allows the lower end 40 to be readily inserted into the opening 16 of the container and allows the fitment 24 to be further inserted until friction between the outer wall 30 and the neck 18 arrests further downward displacement. The upper end 36 of the outer wall 30 and the interior surface 38 of the neck 18 are specifically sized so that the friction required to secure the fitment 24 to the container body 12 is not achieved until the upper end 36 is at approximately the same elevation, or slightly below, the rim 22 of the neck 18.

An advantage of the configuration of the fitment 24 is that the upper end 36 of the fitment 24 does not interfere with the sealing connection between the rim 22 of the container body 12 and the cap (not shown). Thus, the fitment 24 is particularly suited for use in a container body 12 having a finish 14 such as disclosed in U.S. Pat. No. 5,188,249 issued to Cargile and assigned to Graham. Another advantage is that the frustoconical shape of the outer wall 30 and the friction created between it and the neck 18 prevent the fitment 24 from being inserted completely through the neck 18.

The annular locking bead 34 prevents the fitment 24 from being dislodged from the container body 12 during pouring. The annular locking bead 34 extends outwardly from the outer wall 30 and is located a predetermined distance "A" from the upper end 36 of the outer wall 30. When the fitment 24 is frictionally engaged with the neck 18 of the container, the annular locking bead 34 is positioned beneath the shoulder 20 of the container body 12 and prevents the fitment 24 from being dislodged from the container body 12 during pouring.

Another important aspect of the present invention is the formation of multiple sealing bands between the outer wall 30 of the fitment 24 and the interior surface 38 of the neck 18 to ensure creation of a leak-free seal. To this end, the interior surface 38 of the neck 16 includes a pair of spaced apart sealing surfaces, 48 and 50, which frictionally engage the outer wall 30 of the fitment 24. The upper sealing surface 48 is a spaced distance below the rim 22 and has an inner diameter "B". The lower sealing surface 50 is a spaced distance below the upper sealing surface 48 and merges with the shoulder 20 of the container body 12. The lower sealing surface 50 has an inner diameter "C" which is smaller than the inner diameter "B" of the upper sealing surface 48 so that each simultaneously bear against the frustoconical shaped outer wall 30 of the fitment 24. Thus, two separate sealing bands are formed to ensure that liquid cannot leak between the outer wall 30 and the neck 18.

In several other ways, the fitment 24 according to the present invention is similar to known fitments. The spout 26 is connected within the outer wall 30 by the sump 32. The sump 32 extends inwardly from the lower end 40 of the outer wall 30 to the spout 26 and forms a path of flow for residual liquid draining back into the container body 12. The path of flow is defined by angled sump surfaces 42 which lead the residual liquid to a drain aperture 44.

The near-empty pouring aperture 28 is formed in the outer wall 30 by conventional negative draft molding techniques. The near-empty pouring aperture 28 is located such that if the container is manipulated in an opposite pouring direction relative to the spout 26, the last remaining quantity in a near empty container is readily dispensed via the near-empty pouring aperture 28.

A number of stacking ribs 46 project from the spout and prevent stacked fitments 24 from being too tightly compressed upon one another. In addition, legs 52 extend from the bottom of the sump 32 to allow the fitments 24 to stand upright when placed on a horizontal surface.

By way of example, and not by way of limitation, a fitment 24 according to the present invention has an outer wall 30 with a taper of 1° from the vertical to provide an interference fit at diameters B and C in a range of about 0.010 to about 0.030 inches. In the as manufactured state of one preferred embodiment, the upper end 36 of the outer wall 30 has a diameter of 2.342 inches and the lower end has a diameter of 2.327 inches. The wall thickness of the outer wall 30 is 0.040 inches except at the locking bead 34 which is located 0.633 inches from the upper end 36. The inner diameter "B" of the upper sealing surface 48 of the neck 18 is 2.290 inches and the inner diameter of the lower sealing surface 50 is 2.274 inches. Thus, when the fitment is inserted, compressive hoop stresses applied to the outer wall 30 of the fitment provide the desired degree of friction necessary to provide adequate sealing without undue force being required to seat the fitment.

While a preferred fitment configuration and a container assembly have been described in detail, various modifications, alterations, and changes may be made without departing from the spirit and scope of the present invention as defined in the appended claims.

We claim:

1. A fitment for use on a container for dispensing liquids, the container having a finish with an opening defined by a neck, the neck having a rim and a shoulder, the fitment comprising:

an outer wall engageable against the neck of the container within the opening of the container, said outer wall having an upper end and a lower end and having a frustoconical upper portion adjacent said upper end so that said frustoconical upper portion frictionally engages the neck of the container when the fitment is inserted into the opening of the container, said frustoconical upper portion of said outer wall preventing the fitment from being inserted completely through the neck of the container;

an annular bead extending outwardly from said outer wall, said bead being located on said outer wall a spaced distance from said upper end of said outer wall and below said frustoconical upper portion so that when said fitment is engaged in the neck of the container, the bead is positioned directly under the shoulder of the neck to prevent the fitment from being dislodged from the neck of the container during pouring;

a spout spaced from and extending within said outer wall for providing controlled pouring from the container; and a drain portion connecting said spout to said lower end of said outer wall, said drain portion providing a path of flow for liquid draining back into the container after pouring;

said upper end of said outer wall terminating below the rim of the neck of the container when the fitment is engaged in the neck with the bead in engagement with the shoulder.

2. A fitment according to claim 1, wherein said outer wall and said neck form two separate sealing bands.

3. A fitment according to claim 1, wherein said upper end of said outer wall has a greater diameter than said lower end of said outer wall.

4. A fitment according to claim 3, wherein said outer wall tapers at a constant angle between said upper and lower ends relative to a vertical axis through the fitment.

5. A fitment according to claim 4, wherein said constant angle of taper of said outer wall is 1° relative to the vertical axis through the fitment.

6. A fitment according to claim 4, wherein said outer wall has a constant thickness.

7. A fitment according to claim 1, wherein said drain portion is at angle relative to the horizontal and has a drain back aperture.

8. In a liquid dispensing fitment for use with a plastic container, the container having an opening defined by a neck, the neck having a rim and a shoulder, the fitment being engageable within the opening of the container, the fitment having a spout providing controllable pouring from the container and a drain back feature so that liquid remaining on the spout after pouring has a path back into the container, the improvement wherein said fitment comprises:

an outer wall having an upper end and a lower end, a portion of said outer wall below said upper end tapering inwardly from said upper end, so that when the fitment is inserted into the opening of the container, said portion of said tapered outer wall frictionally engages the neck of the container and prevents the fitment from being inserted completely through the neck of the container; and an annular bead extending outwardly from said outer wall, said bead being located on said outer wall a spaced distance from said upper end of said outer wall so that when said fitment is engaged with the neck of the container, the bead is positioned directly under the neck shoulder to prevent the fitment from being dislodged outwardly from the neck of the container during pouring;

said upper end of said outer wall terminating below the rim of the neck of the container when the fitment is engaged in the neck with the bead in engagement with the shoulder.

9. A container assembly comprising:

a plastic blow-molded container body for holding a liquid, said body having an opening defined by a neck, said neck having a rim, an inner wall and a shoulder; and a fitment engageable with said neck of said container body within said opening of said container body;

said fitment having a frustoconical outer wall, said frustoconical outer wall having an upper end and a lower end, said upper end having a greater diameter than said lower end such that when said lower end is inserted into said opening of said container body, a portion of said frustoconical outer wall frictionally engages against said inner wall of said neck of said container body to prevent said fitment from being inserted completely through said neck of said container body;

said fitment having an annular bead extending outwardly from said frustoconical outer wall, said bead being located on said frustoconical outer wall a spaced distance from said upper end of said frustoconical outer wall, so that when said fitment is engaged with said neck of said container body, said bead is positioned directly under said shoulder of said neck and prevents said fitment from being dislodged from the container body during pouring;

said fitment having a spout spaced from and extending within said frustoconical outer wall for providing controlled pouring from the container body;

said fitment having a drain portion connecting said spout to said lower end of said frustoconical outer wall, said drain portion providing a path of flow for liquid draining back into the container body after pouring; and when said fitment is engaged within said neck, said upper end of said frustoconical outer wall is located entirely within said opening and does not extend above said rim of said neck.

10. A container assembly according to claim 9, wherein said inner wall of said neck includes an upper annular sealing surface and a lower annular sealing surface both of which frictionally engage said frustoconical outer wall of said fitment, whereby said sealing surfaces and said fitment create two separate sealing bands to prevent leakage of liquid between said fitment and said neck of said container body.

11. A container assembly according to claim 10, wherein said lower annular sealing surface has a predetermined diameter and said upper annular sealing surface has a predetermined diameter, said upper annular sealing surface diameter being greater than said lower annular sealing surface so that both simultaneously frictionally engage said frustoconical outer wall of said fitment.

12. A container assembly according to claim 11, wherein said upper and lower annular sealing surfaces of said neck are separated a predetermined distance.

13. A container assembly according to claim 12, wherein said upper annular sealing surface is located a spaced distance below said rim of said neck.

14. A container assembly according to claim 13, wherein said lower annular surface merges with said shoulder.

* * * * *

UNITED STATES PATENT AND TRADEMARK OFFICE

CERTIFICATE OF CORRECTION

PATENT NO. : 5,855,299

DATED : January 5, 1999

INVENTOR(S) : Jay C. Arnold

It is certified that error appears in the above-indentified patent and that said Letters Patent is hereby corrected as shown below:

Column 2, line 20, "assembly" should be spelled --assemble--.

Signed and Sealed this

Eighth Day of June, 1999

*Attest:*

Q. TODD DICKINSON

*Attesting Officer*

*Acting Commissioner of Patents and Trademarks*